US005921798A

United States Patent [19]

Ursich

[11] Patent Number: 5,921,798

[45] Date of Patent: Jul. 13, 1999

[54] WATERPROOF LOCKING FEMALE ELECTRICAL SOCKET

[76] Inventor: Nels E. Ursich, 6809 W. Brementowne Dr., Tinley Park, Ill.

[21] Appl. No.: 08/882,377

[22] Filed: Jun. 25, 1997

[51] Int. Cl.[6] ..... H01R 13/625

[52] U.S. Cl. ..... 439/346

[58] Field of Search ..... 439/346, 345, 439/347, 134, 140, 270, 369

[56] References Cited

U.S. PATENT DOCUMENTS

| | | | |
|---|---|---|---|
| 1,404,098 | 1/1922 | Dennis . | |
| 2,198,504 | 4/1940 | Pool . | |
| 2,631,185 | 3/1953 | Earle et al. . | |
| 2,664,734 | 1/1954 | McEneaney . | |
| 2,732,531 | 1/1956 | Janowiec . | |
| 3,121,599 | 2/1964 | Modrey . | |
| 3,200,365 | 8/1965 | Carpinone . | |
| 4,179,175 | 12/1979 | Farnworth et al. . | |
| 4,566,297 | 1/1986 | Hawley . | |
| 4,909,749 | 3/1990 | Long . | |
| 4,925,396 | 5/1990 | Grover | 439/346 |
| 5,129,836 | 7/1992 | Ursich | 439/346 |
| 5,281,162 | 1/1994 | Ursich | 439/346 |
| 5,393,239 | 2/1995 | Ursich | 439/346 |
| 5,413,498 | 5/1995 | Ursich | 439/346 |

FOREIGN PATENT DOCUMENTS

| | | |
|---|---|---|
| 0122842 | 10/1984 | European Pat. Off. . |

*Primary Examiner*—Steven L. Stephan
*Assistant Examiner*—Eugene G. Byrd
*Attorney, Agent, or Firm*—Edward D. Gilhooly, Ltd.

[57] ABSTRACT

A self-locking female electrical receptor having a pair of prong receiving holes mounted on an end. A protector extension is molded on the end of the receptor and includes holes aligned with the prong receiving holes to cover the prongs. A plate is attached to the protector extension.

7 Claims, 2 Drawing Sheets

WATERPROOF LOCKING FEMALE ELECTRICAL SOCKET

BACKGROUND OF THE INVENTION

1. Field of the Invention

This invention relates to electrical cords, and, more specifically, to a waterproof self locking female receptor for an electrical cord.

2. Summary of the Prior Art

As is well known, an electrical female receptacle and a male plug are used to connect electrical lines. One form of such connections is in the well known use of extension cords to deliver electric power to a location remote from an outlet. It is a common problem for a plug to be pulled out from an electrical socket during use for an undesired disconnection from the electrical power. Such a loss of current is not only inconvenient, but can adversely interfere with a task, such as disconnecting electric tools and equipment.

Effective self-locking female receptors for an electrical cord are disclosed in U.S. Pat. No. 5,129,835 issued Jul. 14, 1992, U.S. Pat. No 5,281,162 issued Jan. 25, 1994, U.S. Pat. No. 5,413,498 issued May 9, 1995 and U.S. Pat. No. 5,393,239 issued Feb. 28, 1995, all to Ursich. The foregoing locking receptors retain the male prongs of a plug to prevent undesired separation with the female receptor. The invention of the foregoing patents to Ursich permits easy removal of the male plug by depressing an externally located actuator which allows release of the plug. Although the self-locking female receptors disclosed in the U.S. Pat. Nos. 5,128,836; 5,281,162; 5,413,498 and 5,393,239 provide highly satisfactory results, it is desirable that improvements are provided to such receptacles to attain an optimum waterproof, sealed internal environment and to safely accommodate various lengths of the prongs of male plugs which are conventionally on the market. In the case of varying lengths of the male prongs, a problem exists that a portion of the conductive electrical prong will be exposed beyond the receptacle which can provide hazardous conditions. Accordingly, it is desirable to provide an improved self-locking receptor which is both effectively waterproof and provides protection against hazardous conditions.

SUMMARY OF THE INVENTION

It is an objective of the present invention to provide an effective an economical female electrical receptor which will efficiently lock a male plug element of an electrical line or chord to prevent accidental disconnection. The female receptor of the invention is provided with improved means to seal the interior of the receptor when the plug is in place to prevent intrusion by water and other foreign substances during use, even under rainy or other adverse conditions. In addition, the receptor herein disclosed is provided with an external plate means and to protect or to ensure that metal prongs of varying lengths are situated in complete insertion within the female receptor without external exposure.

DESCRIPTION OF THE PREFERRED EMBODIMENT

Figure 6:
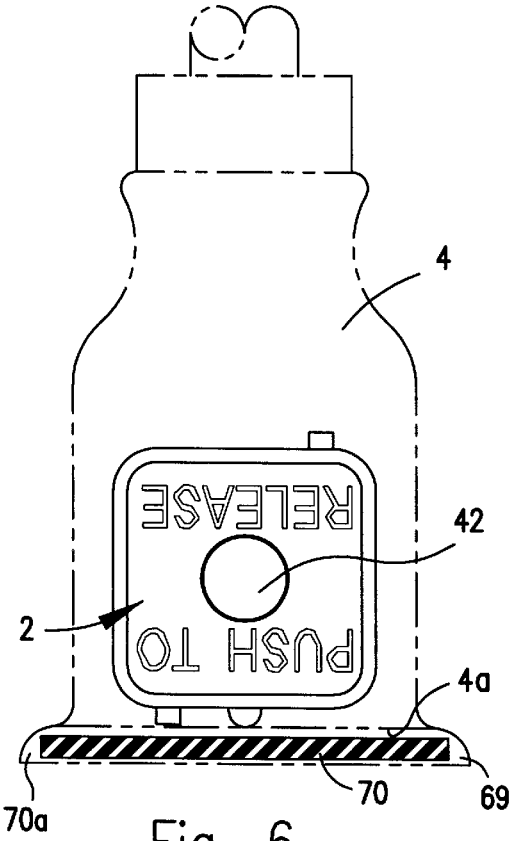
FIG. 6 is a top plan view of the waterproof self-locking female receptor of the invention having the locking mechanism mounted therein.
Figure 7:
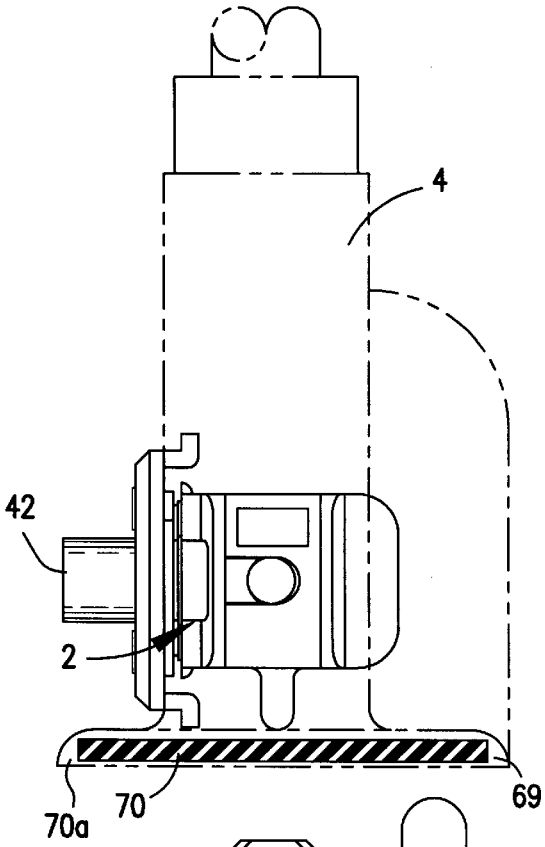
FIG. 7 is a front elevational view of the female receptor of FIG. 6.
Figure 7:
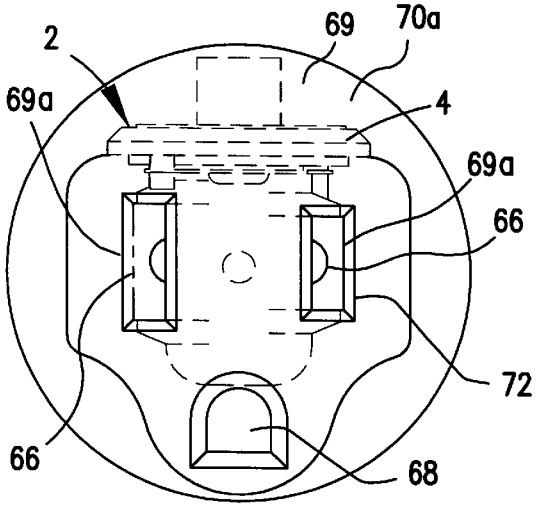
Figure 8:
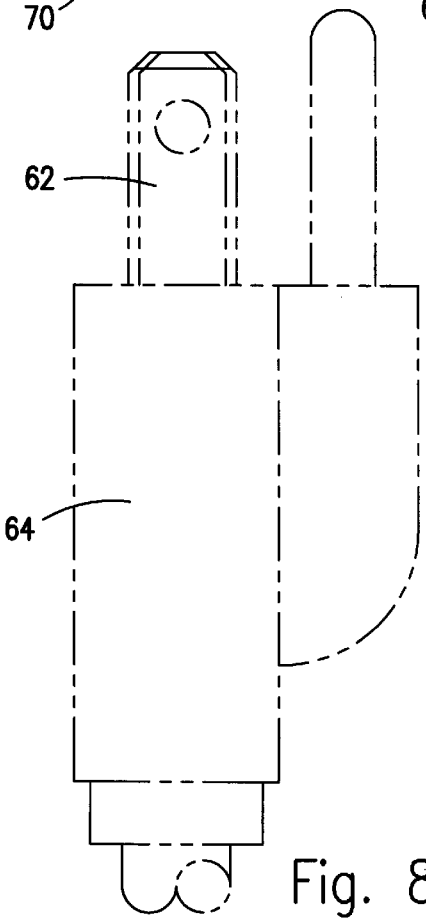
FIG. 8 is a top plan view, with parts removed, showing the female receptor of FIG. 6 and the male plug to be inserted therein.

Referring now to FIGS. 1 to 4, there is illustrated the improved locking mechanism 2 for an electrical female receptor for self-locking the prongs of a male plug of an electrical line to a female receptor connected to an electrical line. As seen in FIGS. 6 to 8, the locking mechanism 2 is arranged to be mounted within a female receptor 4 in a manner to be described. As illustrated in FIGS. 1 to 4, the locking mechanism 2 includes a locking mechanism housing 6 formed of a suitable non-conductive material such as a plastic or hardened rubber. The locking mechanism housing 6 is formed in FIGS. 1 to 4 with a rectangular cross-sectional configuration formed by sidewalls 8 and integral front walls 10 enclosed by an integral bottom wall 12. The walls 8, 10 and bottom wall 12 form an internal cavity 14. The side walls 8 are each formed with an opening from the cavity 14 to the exterior of the side walls 8. The upper end of the locking mechanism body 6 is provided with a rectangular cover 18 attached to the upper portions of side walls 8 and front back walls 10 by an adhesive technique. Although the locking mechanism housing 6 is shown having a generally rectangular configuration, it is within the scope of the invention to construct the locking mechanism housing with another configuration, such as a circular cross section and the like.

A centrally circular opening 20 extends through the cover 18 into the internal cavity 14 of the locking mechanism body 6. A cutout area 22 is provided at the bottom of the cover 18 adjacent side walls 8 and walls 10 for receiving an O-ring 24 to create a water tight seal. The bottom wall 12 of the locking mechanism 6 includes a raised projection 26 (FIGS. 3 and 4) to retain the bottom end portion of a coil spring 26*a* situated within the cavity 14. The exterior of the side walls 8 are provided with projecting lip portions 28 and 30 for defining a prong receiving channel on each side of the locking mechanism housing 6. A tab member 32 (FIG. 2) is affixed to the cover 18 to provide a retention element to aid in affixing the locking mechanism within the female receptor 4. A plunger 40 comprising a solid plastic or hardened rubber is disposed within the opening 20 of cover 18 and extends within the cavity 14. The upper cylindrical portion 42 of the plunger 40 acts as a manual actuator which is externally positioned to allow the cylindrical member 42 to be pressed to release a locked male plug in a manner to be described. An actuator element 44 is formed on the bottom of the cylindrical plunger 40 and includes a generally rectangular configuration having the outwardly projecting top wall 46 in contact with walls 8 and 10 to act as a guide. The upper portion of the actuator element 44 includes a cut out area 48 to form a reduced width adjacent top wall 46 which gradually increases in width to a maximum width at lower portion 50. The bottom 52 of actuator 44 projects outward into contact with walls 8 and 10 to form a lower guide during movement. The cutout area 48 acts to cooperative with a pair of spherical balls 54 of a metal construction which extend outwardly through the opening 16 provided in the side walls 8 of the locking mechanism body 6. A cylindrical hole is formed at the bottom of the actuator member to receive the compression spring 26*a* to resiliently urge the cylindrical plunger upward as seen in FIGS. 3 and 4.

Figure 1:
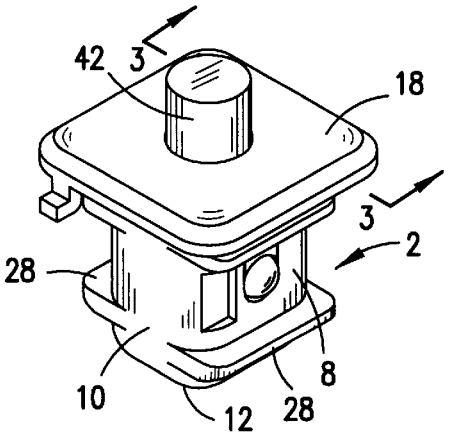
FIG. 1 is a front perspective view of the locking mechanism of the waterproof self-locking female receptor of the invention.
Figure 3:
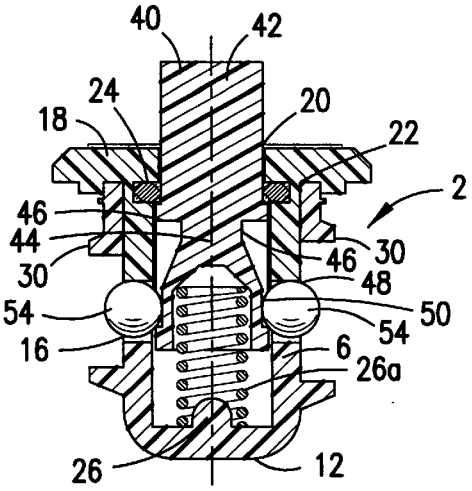
FIG. 3 is a front elevational view, with parts in section, of the locking mechanism of FIG. 1 shown in a locking configuration.
Figure 2:
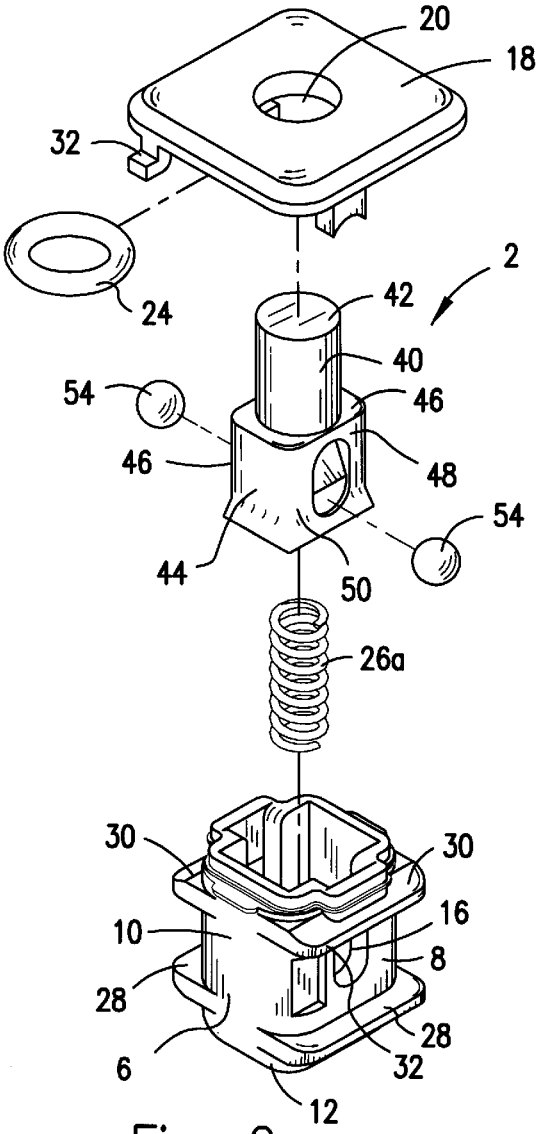
FIG. 2 is a front perspective view with parts exploded of the locking mechanism of FIG. 1.
Figure 4:
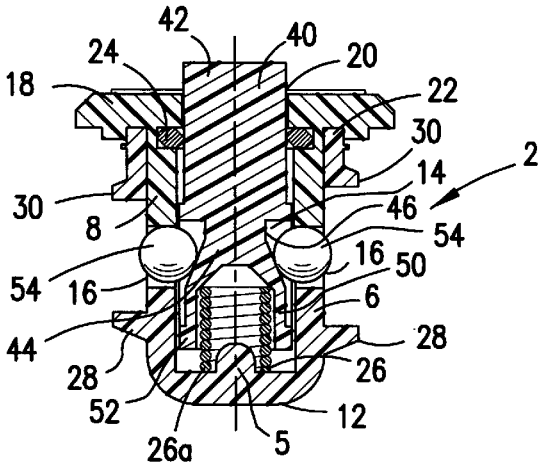
FIG. 4 is a front elevational view, with parts in section, of the locking mechanism of FIG. 1 shown in a released configuration.
Figure 5:
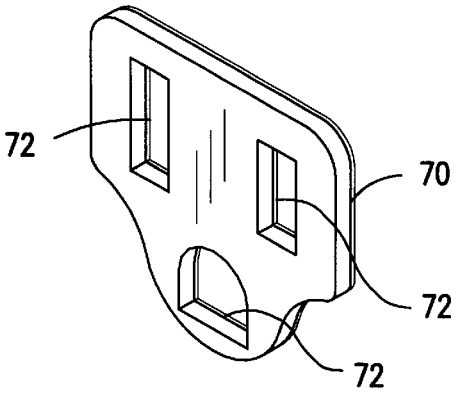
FIG. 5 is a front perspective view of the spacer plate of the female receptor of the invention.

As seen in FIGS. 3 and 4, the cut out area 52 and lower portion 50 of actuator element 44 is spaced from the walls of the housing 6 and have varying widths. As can be seen from FIGS. 3 and 4, the actuator element 44 has its smallest dimension adjacent the upper portion and gradually increases to a greater width at lower portion 50. As a result, as seen in FIG. 3, the balls 54 are urged outward at the maximum diameter of the actuator element to engage the holes 60 of the prongs 62 of a male plug 64 (FIG. 8) and lock the plug when inserted into the female receptacle 4. By depressing the cylindrical member 40, the spring is depressed and the balls may retract into the cutout areas 52 provided in the actuator element by which the male plug 60 may be pulled away from the receptacle as disclosed in U.S. Pat. No. 5,281,162 to which reference is made hereto. In FIGS. 3 and 4, it should be apparent that the O-ring 24 in cover element 18 seals the interior 14 of the locking mechanism body 6 to prevent the passage of foreign substances, such as water, to pass into the cavity 6 even under extreme wet conditions.

Referring now to FIGS. 5 to 8, the mounting of the locking mechanism 2 within the female receptor 4 is shown. The female receptor 4 is formed of a solid material having an internal cutout portion formed in a configuration approximating the external shape of the locking mechanism 2 for mounting the locking mechanism 2 therein. As seen in FIG. 7, as is conventional, the female receptor 4 includes a pair of prong receiving openings 66 exposed on opposite sides of the locking mechanism such that in a locking position in FIG. 4, the balls 54 may engage the prongs 62 of the male plug 60 as shown in FIG. 7. A suitable ground receiving opening 68 is also provided in the female receptor 4 as is conventional.

A protector in the form of an enlarged end 69 creating a continuous raised border portion 69*a* is molded around the periphery of the end 4*a* to the end of female socket 4 to form an exterior extension of the socket holes 66 and ground hole 68. The enlarged end 4*a* surrounds a non-conductive plate 70 having holes 69*a* and 69*b* and holes 69 and 69*b* in alignment with holes 66 and covers the exposed portion of the prongs. The protector 69 is molded as an extension of end 4*a*, but may be suitably affixed to the end 4*a* if desired. As seen in FIG. 7, protector 69 may have a circular cross-sectioned configuration and extend outward from the socket 4. Alternatively, the protector may have a cross section generally approximating the shape of socket 4.

A non-conductive plate 70 of compressible rubber and plastic and the like and also having aligned openings 72 corresponding to the openings 66 provided in the female receptor is mounted within the enlarged end 69 on the exterior of the end 4*a* of female receptor 4 (FIGS. 5, 6, 7 and 8). The plate 70 acts further as a spacer such that a male plug 62 of varying lengths will always be fully inserted within the female receptor due to deformation of plate 70 by male plug 62 regardless of the particular length and still be in alignment for locking. Such a feature prevents exposure of the prongs between the plug body and the female receptor for safety protection. The plate 70 may be used without protector 69 by being affixed by adhesive or fasteners, if desired. The plate 70 may have the same cross-sectional shape as socket 4. As seen in FIGS. 6–8, the hardened enlarged end 69 surrounds the periphery 70*a* of the plate 70.

What is claimed is:

1. A locking female electrical receptor comprising a female receptor body having an end with a pair of holes for receiving the spaced prongs with punch holes of a male plug for electrically connecting two electrical lines respectively coupled to said receptor body and the male plug, said receptor body having locking means mounted within said receptor body, said locking means having a manually operated element being accessible from the outside of said receptor body, said locking means having a body formed with a cavity for receiving said manually operated element, a pair of locking elements mounted in said body in operative relationship to said actuator element adjacent to the spaced prongs for selectively engaging the punched holes of the male plug locking the prongs of the male plug to said receptor body, said manually operated element being moveable to a first position relative to the spaced prongs for permitting insertion and removal of the prongs relative to said locking elements, said manually operated element being moveable to a second position adjacent the prongs within said cavity for simultaneously urging said pair of locking elements into locking contacts with the male prongs of the male plug, sealing means attached to said body and contacting the manually operated element for creating a seal for preventing foreign substances from being introduced into said cavity, protector means having a continuous raised portion formed around the periphery of the end of said female receptor body, and a compressible plate being attached to said female adaptor within said periphery.

2. The female receptor according to claim 1 wherein said sealing means in an O-ring.

3. A female electrical receptor for receiving the space prongs of a male plug comprising a female receptor body having a pair of holes formed on an end of said receptor body for receiving the spaced prongs of a male plug, said female receptor having means for releasably locking the spaced prongs, said holes being open on an end of the receptor body, protection means extending beyond said end to cover exposed portions of the spaced prongs of the male plug, said protection means having a compressible plate affixed to said end, said compressible plate permitting spaced prongs of varying lengths to be inserted in locked relationship in said female receptor body without external exposure.

4. The female electrical receptor according to claim 3 wherein said compressible plate has spaced holes aligned with said pair of holes.

5. The female electrical receptor according to claim 4 wherein said plate is a non-conductive material.

6. The female receptor according to claim 3 wherein said protection means includes a raised periphery on said end, said raised periphery substantially surrounding said compressible plate.

7. A female electrical receptor for receiving the spaced prongs of a male plug comprising a female receptor having a pair of holes formed on an end of said receptor for receiving the spaced prongs of a male prong, said female receptor having means for releasably locking the spaced prongs, protection means extending beyond said end to cover exposed portions of the male plug, and said protection means having a continuous hardened raised portion extending the periphery of said end.

* * * * *